US005632436A

United States Patent [19]

Niewold

[11] Patent Number: 5,632,436

[45] Date of Patent: *May 27, 1997

[54] APPARATUS HAVING CASCADED AND INTERBONDED MICROCHANNEL PLATES AND METHOD OF MAKING

[75] Inventor: Andreas Niewold, Mesa, Ariz.

[73] Assignee: Litton Systems, Woodland Hills, Calif.

[ * ] Notice: The term of this patent shall not extend beyond the expiration date of Pat. No. 5,514,9278.

[21] Appl. No.: 550,593

[22] Filed: Oct. 31, 1995

Related U.S. Application Data

[62] Division of Ser. No. 250,854, May 27, 1994, Pat. No. 5,514,928.

[51] Int. Cl.[6] ..... H01J 43/00

[52] U.S. Cl. ..... 228/121; 313/105 CM

[58] Field of Search ..... 228/121, 124.1, 228/193, 262.21; 313/103 CM, 105 CM

[56] References Cited

U.S. PATENT DOCUMENTS

| | | | |
|---|---|---|---|
| 3,567,947 | 3/1971 | Robbins | 250/213 |
| 4,005,920 | 2/1977 | Wimmer | 316/19 |
| 4,293,986 | 10/1981 | Kobayashi et al. | 228/121 X |
| 4,482,836 | 11/1984 | Washington et al. | 313/104 |
| 4,737,623 | 4/1988 | Uhl | 250/207 |
| 4,825,118 | 4/1989 | Kyushima | 313/104 |
| 4,863,759 | 9/1989 | Warde et al. | 427/108 |
| 4,886,996 | 12/1989 | Field et al. | 313/400 |
| 4,895,291 | 1/1990 | Ozimek et al. | 228/121 |
| 5,097,173 | 3/1992 | Schmidt et al. | 313/103 |
| 5,378,640 | 1/1995 | Kim | 437/5 |

OTHER PUBLICATIONS

Manko *Solders and Soldering 2nd Ed* McGraw–Hill Book Co 1979 pp. 115–119.

*Primary Examiner*—Kenneth J. Ramsey

*Attorney, Agent, or Firm*—Poms, Smith, Lande & Rose

[57] ABSTRACT

A photomultiplier tube, image intensifier tube, or night vision device includes a cascade of plural microchannel plates which are physically and electrically connected together to provide an electron multiplication through the microchannel plate cascade. At least two adjacent microchannel plates in the cascade are also physically interbonded to one another. The bonding of the adjacent microchannel plates may be accomplished by use of a metallic interbonding layer covering all except a peripheral edge portion of at least one face of one or both of the bonded microchannel plates, which interbonding layer confronts and bonds with the other of the bonded microchannel plates. The interbonding layer may cover only a peripheral annular portion of the one face of the one bonded microchannel plate, or only sub-areas of this peripheral annular portion of this one microchannel plate. During manufacturing of such an image intensifier tube, the microchannel plates are initially fabricated and handled as individuals. However, a necessary manufacturing step for the tube also results in the microchannel plates interbonding to one another.

15 Claims, 3 Drawing Sheets

2/3
FIG. 2.
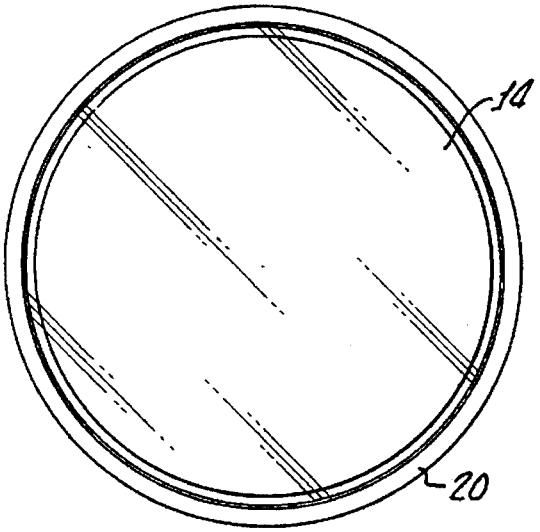
FIG. 3.
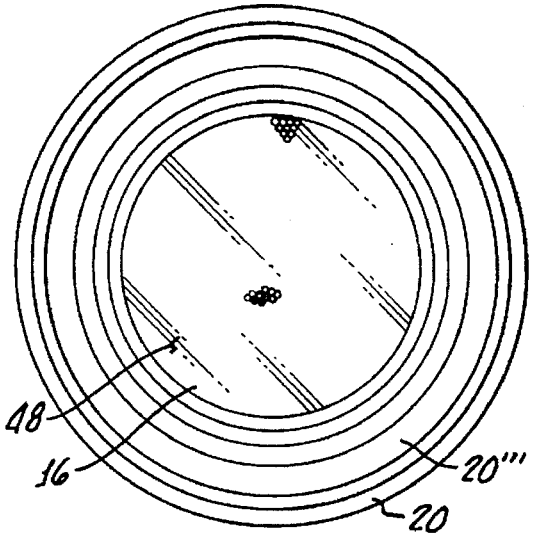
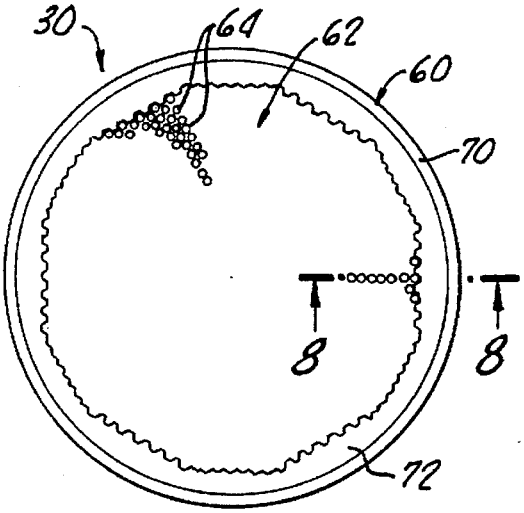
FIG. 7.
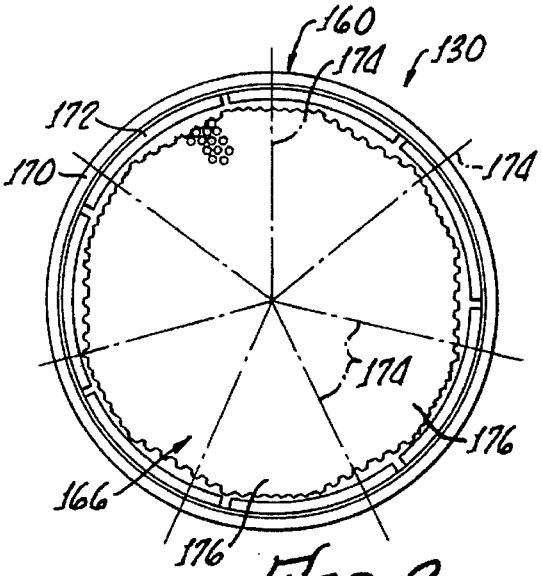
FIG. 9.
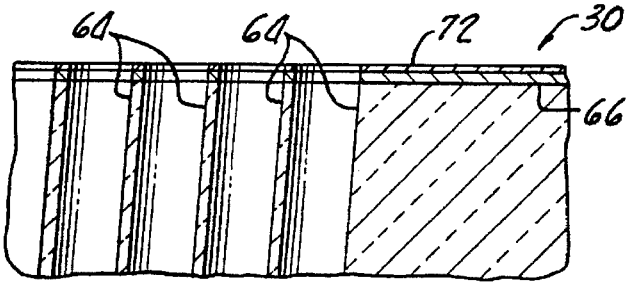
FIG. 8.

APPARATUS HAVING CASCADED AND INTERBONDED MICROCHANNEL PLATES AND METHOD OF MAKING

This is a divisional of application Ser. No. 08/250,854 filed on May 27, 1994, now U.S. Pat. No. 5,514,928.

BACKGROUND OF THE INVENTION

1. Field of the Invention

The present invention relates to an apparatus, such as a high-output photomultiplier tube or image tube, having a microchannel plate. More particularly, the present invention relates to such a high-output photomultiplier tube or image tube having a plurality of sequentially arranged, or cascaded, electron multiplier microchannel plates. Still more particularly, the present invention relates to such a high output photomultiplier tube or image tube having cascaded microchannel plates which are interbonded together to resist dislocation caused, for example, by vibration and jarring of the tube. The present invention also provides a method of making such a tube.

2. Related Technology

Microchannel plates have been used in various devices to intensify low-level images. For example, in night vision devices, a photoelectrically responsive photocathode element is used to receive photons from a low-level image. In other words, the low-level image may be far too dim to view with unaided natural vision, or may be an image of a scene illuminated by invisible infrared light. Such light is rich in the night-time sky. The photocathode produces a pattern of electrons (hereinafter referred to as, "photo-electrons") which corresponds with the pattern of photons from the low-level image. This pattern of photo-electrons is introduced into a microchannel plate, which by secondary emission of electrons in a plurality of small (or micro) channels, produces a shower of electrons in a pattern corresponding to the low-level image. That is, the microchannel plate releases and emits from its microchannels a proportional number of secondary emission electrons. These secondary emission electrons forman electron shower. The shower of electrons, at an intensity much above that produced by the photocathode, is directed onto a phosphorescent screen. The phosphors of the screen produce a visible image in yellow-green light, for example, which replicates the low-level image. Understandably, because of the microchannel plate, the representative image is pixalized, or is a mosaic of the low-level image.

More particularly, the microchannel plate itself conventionally is formed from a bundle of very small cylindrical tubes which have been fused together into a parallel orientation. The bundle is then sliced to form the microchannel plate. These small cylindrical tubes of the bundle thus have their length arranged generally along the thickness of the microchannel plate. That is, the thickness of the bundle slice or plate is not very great in comparison to its size or lateral extent, however the microchannels individually are very small so that their length along the thickness of the microchannel plate is still many times their diameter. Thus, a microchannel plate has the appearance of a thin plate with parallel opposite surfaces. The plate may contain over a million microscopic tubes or channels communicating between the faces of the microchannel plate. Each tube forms a passageway or channel opening at its opposite ends on the opposite faces of the plate. Also, each tube is slightly angulated with respect to a perpendicular from the parallel opposite faces of the plate so that electrons approaching the plate perpendicularly can not simply pass through the many channels without interacting with the interior surfaces of the channels.

Internally the many channels of a microchannel plate are each defined by or are coated with a material having a high propensity to emit secondary electrons when an electron falls on the surface of the material. In addition, the opposite faces of the microchannel plate are provided with a conductive metallic electrode coating so that a high electrostatic potential can be applied across the plate. An electrostatic potential is also applied between the photocathode and the microchannel plate to move the photoelectrons emitted by the photocathode to the microchannel plate. Consequently, electrons produced by the photocathode in response to photons from an image travel to the microchannel plate in the electron pattern corresponding to the low-level light image. These electrons enter the channels of the microchannel plate and strike the angulated walls which are coated with the secondary electron emissive material. Thus, the secondary emission electrons in numbers proportional to the number of photoelectrons, exit the channels of the microchannel plate to impinge on a phosphorescent screen. An electrostatic field between the microchannel plate and the phosphor screen drives the electrons to the screen.

Understandably, the visual image produced by an image intensifier tube is an intensified mosaic image of the low-level scene. Also, because the microchannel plate is supplying a considerably number of electrons which become a part of the electron shower on the phosphorescent screen, the plate is subject to an electrical current between the metallic electrodes on its opposite faces. This electrical current between the opposite faces of a microchannel plate is known as a "strip current" and is an indication of the level of electron multiplication provided by the microchannel plate. This strip current is also an indication of the level of electrical resistance heating experienced by a microchannel plate.

Alternatively, rather than directing the electron shower from a microchannel plate to a phosphorescent screen to produce a visible image, this shower of electrons may be directed upon an anode in order to produce an electrical signal indicative of the light or other radiation flux incident on the photocathode. As will be further explained, a device making such use of a microchannel plate is generally referred to as a photomultiplier, although internally of the device, electrons are cascaded or multiplied rather than photons. The anode electrode may take the form of an array or grid of individual anodes each receiving a respective portion of the electron shower. In this case the current flow or voltage level produced at each of the individual anodes provides an electrical analog to the light or radiation flux falling on the photocathode. This electrical analog signal may be employed to produce a mosaic image by electrical manipulation for display on a cathode ray screen, for example.

Still alternatively, such a microchannel plate can be used as a "gain block" in a device having a free-space flow of electrons. That is, the microchannel plate provides a spatial output pattern of electrons which replicates an input pattern, and at a considerably higher electron density than the input pattern. Such a device is useful, for example, to detect high energy particle interactions which produce electrons. Alternatively, such a device is useful as a particle counter. In such a use, rather than having a photocathode, the device is provided with an input element which sheds an electron when a particle of interest collides with the input element. The shed electron then stimulates the emission of secondary electrons as described above, and an output current signal proportional to the number of particle interactions is produced.

Conventional image tubes and photomultiplier tubes are also known which make use of cascaded microchannel plates. That is, multiple microchannel plates are arranged in series so that the initial electrons from a photocathode, for example, fall into the first microchannel plate. From this first microchannel plate, the secondary electrons from the first plate fall into a second microchannel plate. This second microchannel plate adds its own secondary emission electrons, and provides an increasingly intense shower of electrons. This shower of electrons may flow to a third or subsequent microchannel plate for further multiplication. In this way a very high electron gain or amplification may be effected, with each initial electron falling into the first plate resulting in several hundred to several hundred thousand electrons flowing from the last microchannel plate of the cascade. This electron shower may flow to a phosphor screen for producing a visible image, or to an anode, for example. At the anode, the electron shower becomes a current in a conductor which may be processed to count initial electrons, or to generate an image electronically, for example.

With the conventional photomultiplier tubes using cascaded microchannel plates, the electrostatic potential is connected across the top electrode of the top microchannel plate and the bottom electrode of the last or bottom microchannel plate in the cascade, with reference to the direction of electron flow. Although the microchannel plates of such a conventional photomultiplier tube are in facial contact with one another and are electrically connected in series, they are not otherwise connected. Each of the microchannel plates in the cascade experiences the same strip current flow.

A conventional microchannel plate is known in accord with U.S. Pat. No. 4,737,013, issued 12 Apr. 1988, to Richard E. Wilcox. This particular microchannel plate has an improved ratio of total end open area of the microchannels to the area of the plate. As a result, the photoelectrons are not as likely to miss one of the microchannels and impact on the surface of the microchannel plate to be bounced into another one of the microchannels. Such bounced photoelectrons, which then produce a number of secondary electrons from a part of the microchannel plate not aligned with the proper location of the photoelectron, provide noise or visual distortion in the image produced by the image intensifier. The image intensifier taught by the Wilcox patent solves this problem of the conventional technology.

Other specific examples of the uses of microchannel plates are found in the image intensifier tubes of the night vision devices commonly used by police departments and by the military for night time surveillance, and for weapon aiming. However, as mentioned above, microchannel plates may also be used to produce an electric signal indicative of the light flux or intensity falling on a photocathode, and even upon particular parts of the photocathode. In other words, if a single anode is disposed at the location ordinarily occupied by the phosphorescent screen, this anode will provide a current indicative of the photons received from a low-level scene. If the single anode is replaced with a grid or array of anodes, the various anode portions of the grid or array will provide individual electrical signals which are an electrical analog of the image mosaic. Consequently, these electrical signals can be used to drive a video display, for example, or be fed to a computer for processing of the information present in the electrical analog of the image. In this way, a microchannel plate may be used in a photomultiplier tube to produce an image for indirect viewing through the further use of a video display or computer to process the electrical signals produced by the photomultiplier tube.

In view of the above, it is also easily understood that an electron multiplier tube can be considered as an image intensifier, and could be used as a detector for electronically detecting the occurrence of events which produce photons, such as collisions in a test chamber of a particle accelerator. When such an image intensifier is provided with an array of anodes, the occurrence of a signal at one of the anodes indicates the occurrence of an event, and the location and intensity of the signal can provide information about the event, including the location of the event in a field of view of the photomultiplier tube. An array of such detectors may be used to provide multiple indications of such events, and to provide comprehensive positional information about the events, including computer-generated video and graphical representations about the particle collision events occurring in a large test chamber, for example.

However, conventional technology using cascaded microchannel plates all suffer from the deficiency that some of the individual microchannel plates in a cascade of microchannel plates are generally not fully secured in the tube housing. While one or more of the cascaded microchannel plates may be secured to the housing of the tube, others of the cascaded microchannel plates are secured in position simply by their facial frictional (and electrical) contact and interface with adjacent microchannel plates in the cascade. While this construction of the conventional devices has been satisfactory for most of the image intensifier tubes and photomultiplier tubes of the conventional technology, greater uses for these devices have revealed use environments in which the "loose" microchannel plates may be vibrated or jarred out of position. That is, if an image intensifier tube, for example, is subjected to an impact or jarring which shifts one or more of the cascade of microchannel plates relative to the other microchannel plates of the cascade, then the optimal operating relationship of these cascaded microchannel plates may be disturbed. The result may be a degradation of the image quality provided by the image tube. The same applies with respect to photomultiplier tubes using cascaded microchannel plates.

SUMMARY OF THE INVENTION

In view of the deficiencies of the conventional related technology, it is a primary object for this invention to provide a cascaded microchannel plate assembly in which the microchannel plates are interbonded physically to one another in facial relationship.

Another object for the present invention is to provide an image intensifier tube including such an interbonded cascade of microchannel plates.

Still another object for this invention is to provide a photomultiplier tube having such an interbonded cascade of microchannel plates.

Yet another object for the present invention is to provide a method of making an interbonded cascade of microchannel plates.

Another object is to provide a microchannel plate and a method of making such microchannel plates for interbonding with one another, which during manufacturing of both the microchannel plates themselves and of a product (such as an image intensifier tube or photomultiplier tube) having a cascade of such microchannel plates, the microchannel plates are handled as individuals and not as an interbonded cascade.

An object of the present invention is to provide a microchannel plate and a method of making such microchannel plates as described immediately above such that the individual microchannel plates will interbond to one another to form an interbonded cascade of microchannel plates during a final or near-final manufacturing step ordinarily conducted in the making of the tube product.

Accordingly, an object for this invention is to provide a method of making a product (such as an image intensifier tube or photomultiplier tube having a cascade of microchannel plates interbonding to one another.

Further to the above, the present invention provides a cascaded microchannel plate assembly comprising a first microchannel plate and a second microchannel plate which are stacked in physically and electrically contacting cascaded engagement with one another, and means interposing between the microchannel plates for interbonding the first and second microchannel plates to one another to unite the microchannel plates into a unitary structure.

Still further to the above and according to another aspect of the present invention, this invention provides a vibration and shock resistant tube having a cascaded microchannel plate assembly which is resistant to relative movement of the cascaded microchannel plates in the assembly, the tube comprising a chambered housing having an input window at a forward end thereof for receiving photons; a photocathode within the chambered housing for receiving the photons and responsively releasing photo-electrons in a shower having a pattern replicating the photons; a cascaded microchannel plate assembly for receiving the photo-electrons and responsively releasing proportionate secondary emission electrons to produce an intensified electron shower in a pattern replicating the photons, the cascaded microchannel plate assembly including at least two sequentially disposed microchannel plates which are in physically contacting and electrically conducting relation to one another, the sequentially disposed microchannel plates being interbonded to one another to resist relative movement as may result from vibration or shock applied to the tube.

Also, the present invention provides a method of making a tube having a cascade of interbonded and electrically connected microchannel plates, the method including the steps of providing a microchannel plate having a disk-like substrate of glass defining in a central active area thereof a multitude of microchannels extending between substantially planar opposite faces of the microchannel plate; providing a respective pair of electrode metallic layers, one on each of the opposite faces of the microchannel plate, for application of an electrostatic change there across; providing on at least one of the pair of electrode metallic layers, and covering at least a portion thereof, an interbonding coating for fusing to one of a like interbonding coating or to an electrode layer of an adjacent microchannel plate.

These and additional objects and advantages of the present invention will be apparent from a reading of the following detailed description of a single preferred exemplary embodiment of the invention, taken in conjunction with the following drawing Figures, in which the same reference numbers refer to the same feature, or to features which are analogous in structure or function.

DESCRIPTION OF THE DRAWING FIGURES

FIG. 1 provides a side elevation cross sectional view of an image intensifier tube embodying the present invention;

FIG. 2 is a frontal elevation view of the image intensifier tube seen in FIG. 1;

FIG. 3 is a rear elevation view of the image intensifier tube seen in FIGS. 1 and 2;

Figure 1:
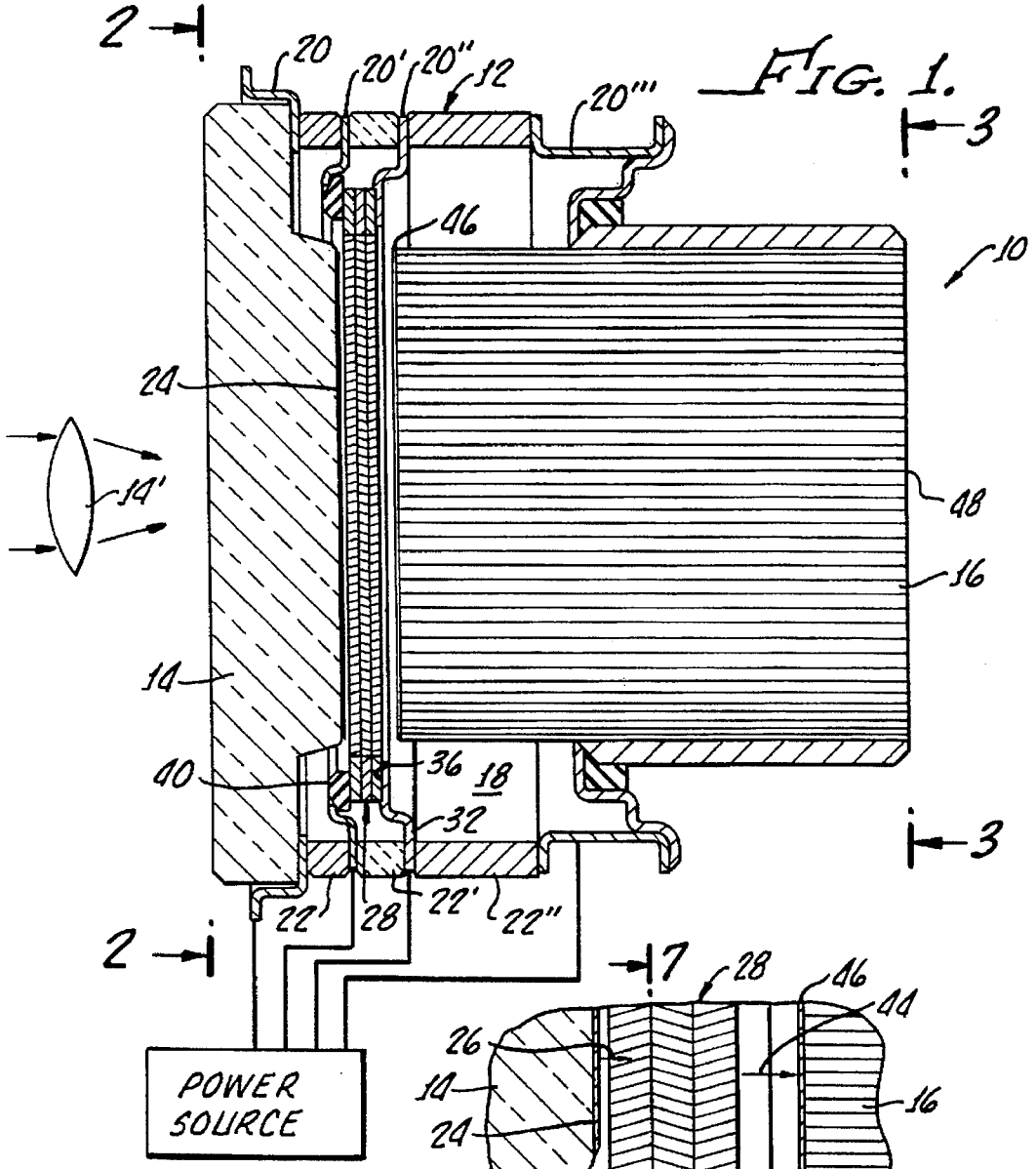
Figure 4:
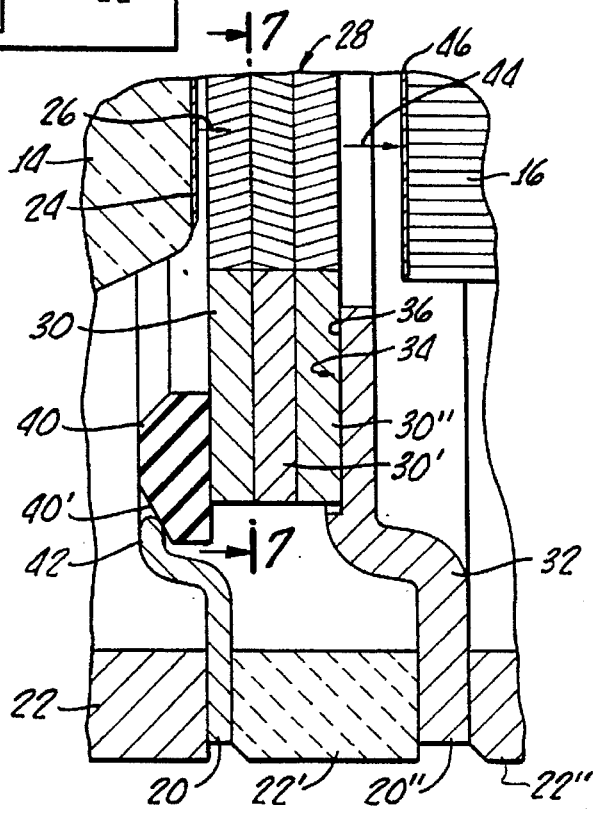
Figure 5:
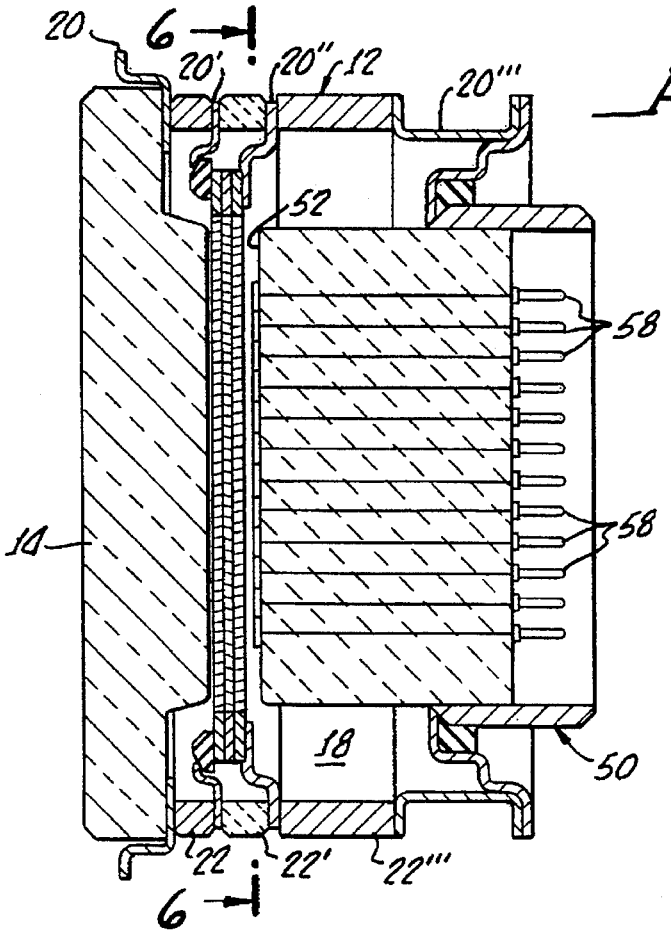
Figure 6:
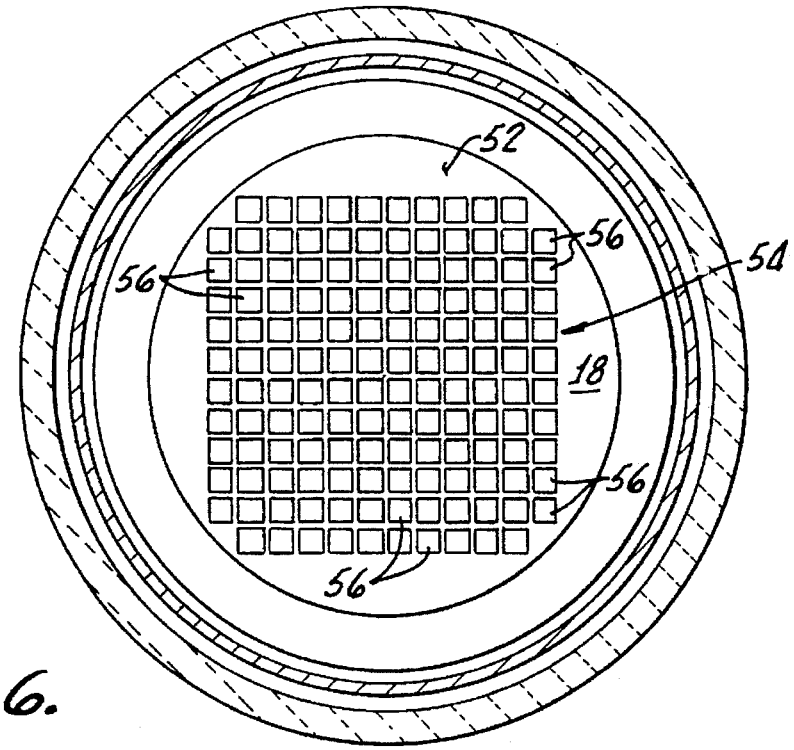

FIG. 4 provides an enlarged fragmentary cross sectional view of a portion of the image intensifier tube seen in FIG. 1;

FIG. 5 is a side elevation cross sectional view similar to FIG. 1, but showing a photomultiplier tube embodying the present invention;

FIG. 6 provides an enlarged fragmentary cross sectional view taken at line 6—6 of FIG. 5;

FIG. 7 is a greatly enlarged cross sectional elevation view taken at line 7—7 of FIG. 4;

FIG. 8 provides a still more greatly enlarged fragmentary cross sectional view taken at line 8—8 of FIG. 7; and FIG. 9 provides a view similar to that of FIG. 7, but showing an alternative embodiment of the present invention.

DESCRIPTION OF THE PREFERRED EXEMPLARY EMBODIMENTS OF THE INVENTION

Viewing FIGS. 1–4 in conjunction with one another, and viewing first FIG. 1, the numeral 10 designates an image intensifier tube embodying the present invention. The image intensifier tube 10 includes a tubular body 12, which is closed at opposite ends by a front light-receiving window 14, and by a rear fiber-optic image output window 16. Both of the windows 14 and 16 are sealingly engaged with the body 12, so that an interior chamber 18 of the body can be maintained at a vacuum relative to ambient. The tubular body 12 is made up of plural annular metallic tubular sections, each indicated with the number 20 with a prime added thereto (i.e., 20, 20', 20", and 20'") as is necessary to distinguish the individual sections from one another. The tubular body sections 20 are spaced apart and are electrically insulated from one another by interposed insulator rings, each of which is indicated with the numeral 22 with a prime added thereto (i.e., 22, 22', and 22") as used above. The sections 20 and insulators 22 are sealingly attached to one another. End sections 20 and 20'" are sealingly attached to the respective windows 14 and 16. Those ordinarily skilled in the pertinent arts will know that the body sections 20 are individually connected electrically to an electrostatic power supply (schematically shown in the drawing Figures, and referenced as "Power Source") which is effective during operation of the image intensifier tube 10 to maintain an electrostatic field most negative at the section 20 and most positive at the section 20'".

Viewing FIGS. 1 and 4 together, it is seen that the front window 14 carries on its rear surface within the chamber 18 a photocathode 24. This photocathode 24 is responsive to photons of light entering through the front window 14 to release electrons (hereinafter referred to as photoelectrons). Those ordinarily skilled in the pertinent arts will recognize that the light entering the front window 14 will be focused upon the photocathode 24 to produce an image. A lens for this purpose is schematically depicted in FIG. 1, and focusing of light by this lens onto photocathode 24 is indicated by the arrows associated with this lens. This image will be too dim to be viewed with the natural vision, and may be entirely or partially of infrared red light which is invisible to the human eye. Alternatively, the photocathode may be responsive to ultraviolet light, which is also invisible to the human eye, to release photoelectrons. However, the photocathode 24 will respond to this image by releasing a shower of photoelectrons in a pattern replicating the image. This shower of photoelectrons is indicated in the drawing Figures with an arrowed numeral 26. Because of the imposed electrostatic field, the photoelectron shower 26 falls upon a cascade 28 of three stacked microchannel plates 30. Each of the microchannel plates in the cascade 28 is indicated with the numeral 30, having a prime added thereto as is necessary to distinguish the individual microchannel plates from one another (i.e., 30, 30', and 30").

FIG. 4 reveals that the cascade 28 of microchannel plates 30 is carried on a stepped inner flange portion 32 of the housing section 20". That is, the housing section 20" includes an inner flange portion 32, and this flange portion defines a step 34 so that an axially disposed ledge 36 surrounded by a radially disposed shoulder 38 is provided. The microchannel plate 30" rests upon the ledge 36 and is positioned radially relative to the housing 10 by the shoulder 38. The microchannel plates 30' and 30 are stacked on the microchannel plate 30" so that facial metallic electrode coatings (not depicted in FIG. 4, but described in connection with FIG. 8) of each are in physically contacting and electrically conducting relationship. A resilient spring snap ring 40 having a chamfered radially outer surface 40' is disposed axially between a radially inner portion 42 of the tubular housing section 20 and the forward one 30 of the cascade 28 of microchannel plates 30. This resilient spring snap ring 40 is effective because of the wedging action from the surface 40' in cooperation with the portion 42 to apply an axial clamping force on the stack of microchannel plates 30. As will be further explained, this axial clamping force is initially sufficient to retain the cascade 28 of microchannel plates 30 in the illustrated preferred position relative to one another and relative to the housing 12 until these microchannel plates are interbonded immovably to one another during the manufacturing process for the tube 10.

As those who are ordinarily skilled in the pertinent arts will appreciate, the shower 26 of photoelectrons falling into the various channels (identified below) of the microchannel plates 30 causes these plates to liberate a proportionate number of secondary emission electrons. As these secondary emission electrons travel through the cascade 28 of microchannel plates 30, the photoelectrons and secondary emission electrons initially liberated further interact with the successive microchannel plates 30 in the cascade so that still additional secondary emission electrons are released. The resulting flow of secondary emission electrons from the microchannel plates 30, indicated with the arrowed numeral 44, and now several orders of magnitude more intense than the shower 26, still replicates the image focused on the photocathode 24. The microchannel plates 30 originate the secondary emission electrons, and this causes the strip current flow in these plates which was mentioned above. As a result, the individual microchannel plates in the cascade 28 act as a voltage divider, so that each carries substantially the same strip current.

On the front face of the fiber optic rear window within the chamber 18 is carried a phosphor screen 46, which is also electrically connected to the housing section 20'''. Because of the applied electrostatic field, the shower 44 of electrons falls on the phosphor screen 46 to produce a visible image in phosphor yellow-green light, for example. This visible image is conducted through the fiber optic output window 16 and is presented on the rear surface 48 thereof. Because of the discreet passage construction of the microchannel plates 30 as well as the discreet optical fiber construction of the fiber optic output window 16, the image available at surface 48 is a mosaic of the image focused on the photocathode 24.

Viewing now FIGS. 5 and 6 in conjunction, an alternative embodiment of the present invention is depicted. This embodiment of the present invention takes the form of a photomultiplier tube. Because many of the features of the embodiment seen in FIGS. 5 and 6 are the same as or are analogous to those depicted and described in connection with FIGS. 1–4, the same reference numeral is used in connection with this second embodiment to indicate the same feature or features which are analogous in structure or function. The photomultiplier tube 10 includes a tubular body 12 closed at one of its two opposite ends by an input window 14. At the other of its opposite ends, the body 12 is closed by an insulative multi-conductor electrical connector assembly 50. FIG. 6 depicts the inner surface 52 of the connector assembly 50 within the chamber 18. On this inner surface 52, an array 54 of individual electrodes (anodes) 56 is presented to the shower 44 of electrons emerging from the rear face of the cascaded microchannel plates 30. Each of the anodes 56 is individually electrically connected through the connector 50 to a respective connector pin 58 presented outwardly on the body 12.

Because a certain level of electrons falls on each one of the array 54 of anodes 56, these anodes will have a respective imposed voltage or current flow. The various voltage or current flows from the anodes 56 is available externally of the photomultiplier tube 10 by electrical connection to the pins 58. These electrical voltage or current flow levels at the pins 58 represent in electrical form a mosaic of the image focused on the photocathode 24. Depending on the size of the individual anodes 56, this mosaic may have a blocky form with resolution sufficient only to reveal gross features of the image, or may with sufficiently small anodes 56 present a fine mosaic with small-feature resolution. As explained above, this electrical analog image mosaic may be viewed by use of video equipment or may be processed with a computer for storage or viewing.

Viewing now FIGS. 7 and 8, a frontal view and a greatly enlarged fragmentary cross sectional view of only one of the microchannel plates 30 is presented. Viewing FIG. 7, it is seen that the microchannel plates 30 are composed of a thin perforate disk 60 of glass having a central portion, indicated with the arrowed lead line 62, defining a great multitude of small through passages 64, or microchannels. On each of the opposite faces of the microchannel plates 30 is carries a very thin metallization coating 66 of, for example, Nichrome or Inconel. Preferably, this metallization coating is in the thickness range from about 50 angstroms to about 150 angstroms. This coating is sufficiently thick to act as an electrical conductor across the face of the microchannel plate 30, and to electrically connect the adjacent microchannel plates 30 in the cascade stack 28.

However, the metallization coating 66 does not extend to the outer peripheral edge 68 of the disk 60. As a result, a peripheral edge portion 70 of the glass disk is exposed and acts as an electrical insulator against shorting across the microchannel plate 30. Atop the metallization coating 66 is carried an even thinner bonding coating of solder or diffusion bond material 72. This coating 72 is preferably in the thickness range of from about 10 angstroms to about 50 angstroms or more in thickness. Importantly, even though this coating will partially liquify or effect a diffusion bond with an adjacent coating of a next-adjacent microchannel plate during manufacturing of the tube 10, the coating of material 72 is sufficiently thin that migration does not occur such as would close or partially obstruct the microchannels to interfere with the operation of the microchannel plate 30.

A preferred material for the coating 72 is indium tin solder alloy with a bonding temperature of about 118 degrees Celsius. During manufacturing of the tube 10, the microchannel plates 30 are installed individually and are secured on the ledge 36 with the spring ring 40, as was depicted and described in connection with FIG. 1. However, these same manufacturing operations for the tube 10 include a subsequent final, or near-final, vacuum baking operation using temperatures up to about 350 to 400 degree Celsius. This elevated temperature in conjunction with the axial compressive force applied by the spring ring 40 causes the material layers 72 of the adjacent microchannel plates to interbond into a unitary structure. Subsequent to the manufacturing operations completing the tube 10, and cooling to ambient temperature, the cascade 28 of microchannel plates 30 is a unitary interbonded structure so that the plates 30 cannot shift relative to one another regardless of how severe may be the vibration or shock to which the tube 10 is subjected.

An alternative material which may be used to make the interbonding coating 72 is gold. The gold metal will form a diffusion bond during the elevated-temperature processing step for the image tube 10 with the adjacent nichrome or inconel material on the adjacent microchannel plate of the cascade 28. In this regard it is to be recognized that the plates 30 of the cascade 28 which are to interbond with one another do not each have to have an interbonding coating 72 on each of the confronting surfaces of these plates. It will be sufficient if only one of the microchannel plates 30 carries the necessary interbonding coating. During the elevated temperature period of the subsequent manufacturing step and under the effect of the applied axial force from the spring ring 40, the necessary interbonding, either with the solder alloy or with diffusion bonding of the gold, between the layers of nichrome or inconel will be effected.

An alternative embodiment of the present invention which extends the above outlined concept further is depicted in FIG. 9. In order to obtain reference numerals for use in describing the embodiment of FIG. 9, features which are the same or which are analogous in structure or function to features described above are referenced with the same numeral used above and increased by one-hundred. A microchannel plate 130, includes a perforate disk 160 of glass having on each of the two opposite faces thereof, including across a central area 162 thereof, a coating 166 of metallic electrode material. As described above, preferably the coating 166 is nichrome or inconel. However, in order to interbond the adjacent microchannel plates of a cascade such as is illustrated in FIG. 1, the plate 130 includes an annular area 172 of bond material, such as a thin coating of indium tin alloy or of gold, as described above.

However, rather than covering the entire central portion of the faces of the microchannel plate 130, the bond material 172 is disposed outwardly of the central area 162, and in an annulus as is depicted between this central area and the peripheral edge portion 170. The coating 172 of bond material in the annular area may be continuous circumferentially, or it may be interrupted circumferentially in order to further reduce the requirements for this coating material. This reduction in the use of the coating material may be especially important when gold is used as the interbonding material for the microchannel plates. FIG. 9 depicts with dashed lines 174 that the annular area 172 may be divided into circumferentially extending areas, each indicated with the numeral 176. For example, if the annular area of the coating 172 is divided into seven circumferentially extending arcuate areas 176, and four of these areas are coated with bonding material, alternating with three of the areas which are not so coated, then when like microchannel plates are stacked together, as is indicated in FIG. 1, they will still interbond to form a unitary structure with a minimal use of the interbonding material. That is, a portion of the four areas of one microchannel plate with interbonding coating will contact at least a portion of the interbonding areas of the next-adjacent microchannel plate 130 in the stack.

While the present invention is depicted, described, and is defined by reference to a single preferred exemplary embodiment of the invention, such reference is not intended to imply a limitation on the invention, and no such limitation is to be inferred. The invention is subject to considerable modification and alteration, which will readily occur to those ordinarily skilled in the pertinent arts. Accordingly, the depicted and described preferred exemplary embodiment of the invention is illustrative only, and is not limiting on the invention. The invention is intended to be limited only by the spirit and scope of the appended claims, giving full cognizance to equivalents in all respects.

We claim:

1. A method of making a tube having a cascade of interbonded and electrically connected microchannel plates, said method including the steps of:

providing a microchannel plate having a disk-like substrate of glass defining in a central active area thereof a multitude of microchannels extending between substantially planar opposite faces of said microchannel plate;

providing a respective pair of electrode metallic layers, one on each of the opposite faces of said microchannel plate, for application of an electrostatic charge there across;

providing on at least one of said pair of electrode metallic layers, and covering at least a portion thereof, an interbonding coating for fusing to one of a like interbonding coating or to an electrode layer of an adjacent microchannel plate;

further including the step of disposing said microchannel plate adjacent to and in face-to-face contacting relation with an adjacent microchannel plate of said cascade during manufacturing assembly of said tube, and using a manufacturing operation for said tube which includes exposing said tube to a processing temperature of about 118 degrees Celsius or higher to also simultaneously interbond said microchannel plate to said adjacent microchannel plate.

2. A method of making a microchannel plate, which microchannel plate is adapted for self-interbonding at a certain temperature ordinarily encountered during a furnace operation for a vacuum tube housing of a device including said microchannel plate, said microchannel plate in response to exposure to said certain temperature during the furnace operation simultaneously interbonding to a next-adjacent microchannel plate to form an assembly of plural cascaded and interbonded microchannel plates, said method comprising steps of:

providing a microchannel plate having a disk-like body of insulative glass defining a pair of opposite faces, forming in a central region of said disk-like body a great multitude of fine-dimension microchannel passages each extending through said disk-like body between and opening on each one of said pair of opposite faces, providing means at each microchannel passage of said great multitude of microchannel passages for defining a respective secondary-electron-emitting distributed dynode extending substantially between said pair of opposite faces, and providing a peripheral rim portion of said disk-like body completely circumscribing said central region thereof;

providing a pair of surface-metallization electrodes, each one disposed on a respective one of said pair of opposite faces of said disk-like body and covering all of said central region as well as a radially inner part of said peripheral rim portion but leaving a radially outer peripheral part of said peripheral rim portion free of surface-metallization, and using said pair of surface-metallization electrodes to distribute an electrostatic charge across each one of said opposite faces to establish a voltage differential across said microchannel plate and to supply secondary-emission electrons to said distributed dynode at each of said multitude of microchannel passages;

providing a layer of interbonding material on one of said surface-metallization electrodes; and using a material to form said layer of interbonding material which will bond either to a surface-metallization electrode of another microchannel plate, or to a similar layer of interbonding material of another microchannel plate, at said certain temperature.

3. The method according to claim 2 in which said method comprises the further step of configuring said layer of interbonding material to cover only a circumferentially extending peripheral annular part of said peripheral rim portion of said disk-like body atop of said surface-metallization electrode, and which peripheral annular part is disposed upon said radially inner part of said peripheral rim portion of said disk-like body, thereby leaving said central region free of interbonding material and with said surface-metallization electrode exposed on said central region of said disk-like body, and with said radially outer peripheral part of said peripheral rim free of both said surface-metallization electrode and said interbonding material.

4. The method according to claim 3 in which said method comprises the further step of configuring said layer of interbonding material to cover only interrupted arcuate segments within said circumferentially extending peripheral annular part of said disk-like body.

5. The method according to claim 2 in which said method comprises the further step of configuring said layer of interbonding material to cover all of said central region and a radially inner part of said peripheral rim portion of said disk-like body, and leaving said radially outer peripheral part of said peripheral rim portion of said disk-like body free of both said surface-metallization electrode and said interbonding material.

6. The method according to claim 2 further including the step of selecting said interbonding material from the group including alloys of indium tin, and gold.

7. The method according to claim 6 further including the steps of selecting said interbonding material from the alloys of indium tin, and selecting a eutectic alloy of indium tin as said interbonding material.

8. A unitary cascaded microchannel plate assembly comprising: a pair of microchannel plates each defining a respective pair of opposite faces, said pair of microchannel plates being stacked in physically and electrically contacting face-to-face cascaded engagement with one another, each of said pair of microchannel plates having a respective body of insulative glass defining said respective pair of opposite faces, a respective central region of said disk-like body of each of said pair of microchannel plates defining a great multitude of fine-dimension microchannel passages, each microchannel passage extending through the respective disk-like body between and opening on each one of said respective pair of opposite faces thereof, means at each one of said great multitude of microchannel passages of said pair of microchannel plates for defining a respective secondary-electron-emitting distributed dynode extending substantially between said pair of opposite faces of the respective one of said pair of microchannel plates, and each of said pair of microchannel plates including a peripheral rim portion of said disk-like body completely circumscribing said central region thereof; each of said pair of microchannel plates including a respective pair of surface-metallization electrodes, each surface-metallization electrode being disposed on a respective one of said pair of opposite faces of the disk-like body of the respective microchannel plate, and said surface-metallization electrode covering all of said central region as well as a radially inner part of said peripheral rim portion but leaving a radially outer peripheral part of said peripheral rim portion free of surface-metallization, and at least one of said pair of microchannel plates carrying a layer of interbonding material atop a respective one of said pair of surface metallization electrodes and disposed toward and interbonding with a respective surface-metallization electrode of the other of said pair of microchannel plates to unite said pair of microchannel plates into a unitary structure; and said layer of interbonding material covering only a peripheral annular portion of said at least one microchannel plate leaving said central region of said at least one microchannel plate free of interbonding material and with said surface-metallization electrode of said one microchannel plate exposed on said central region thereof toward the other of said pair of microchannel plates.

9. The unitary cascaded microchannel plate assembly according to claim 8 wherein said interbonding material is selected from the group including alloys of indium tin, and gold.

10. The unitary cascaded microchannel plate assembly according to claim 9 wherein said interbonding material is selected from the alloys of indium tin, and is a eutectic alloy of indium tin.

11. A microchannel plate capable of self-interbonding with a second microchannel plate at a certain temperature, which certain temperature is ordinarily encountered in a furnace operation for a vacuum tube housing of a device including said microchannel plate, and which furnace operation includes use of temperatures over 118° C. and as high as about 350° to 400° C., said microchannel plate comprising:

a disk-like glass substrate defining a pair of planar opposite faces and a circumferentially-extending edge surface, said pair of opposite faces each defining a central area within which said substrate defines a great multitude of microchannels opening on said pair of opposite faces, and a solid outer peripheral rim portion of said substrate at said pair of opposite faces being free of microchannels and circumscribing said central area thereof;

a pair of metallic electrode coatings disposed one on each of said pair of opposite faces of said microchannel plate and covering said central area as well as a radially inner part of said outer peripheral rim portion for receiving and distributing an electrostatic potential across said microchannel plate; and an interbonding coating having a bonding temperature which is reached or exceeded by said certain temperature, said interbonding coating being carried on at least one face of said pair of opposite faces atop said metallic electrode coating thereof for interbonding said microchannel plate to a second microchannel plate when said microchannel plate and the second microchannel plate are placed in face-to-face contacting and electrically conducting relation and are thereafter exposed to said certain temperature during the furnace operation.

12. The microchannel plate of claim 11 wherein said layer of interbonding material covers only a peripheral annular portion of said microchannel plate leaving said central area of said microchannel plate free of interbonding material and said surface-metallization electrode of said microchannel plate exposed on said central area thereof toward the second microchannel plate.

13. The microchannel plate of claim 11 wherein said layer of interbonding material is disposed within a peripheral annular portion of said microchannel plate atop said surface-metallization electrode and is configured as separated arcuate segments leaving said central area of said microchannel plate free of interbonding material and said surface-metallization electrode of said microchannel plate exposed on said central area thereof toward the second microchannel plate.

14. The microchannel plate of claim 11 wherein said interbonding material is selected from the group including alloys of indium tin, and gold.

15. The microchannel plate of claim 14 wherein said interbonding material is selected from the alloys of indium tin, and is a eutectic alloy of indium tin.

* * * * *